US007227091B2

(12) United States Patent
Gacond et al.

(10) Patent No.: US 7,227,091 B2
(45) Date of Patent: Jun. 5, 2007

(54) MECHANICAL CONTROL DEVICE FOR AN ELECTRICAL SWITCHGEAR WITH THREE SWITCHING POSITIONS, PROVIDED WITH A SELECTION LEVER COOPERATING WITH A CAM

(75) Inventors: Marius Gacond, Aarau (CH); Peter Von Allmen, Buchs (CH)

(73) Assignee: Areva T&D AG, Oberentfelden (CH)

( * ) Notice: Subject to any disclaimer, the term of this patent is extended or adjusted under 35 U.S.C. 154(b) by 0 days.

(21) Appl. No.: 11/267,493

(22) Filed: Nov. 4, 2005

(65) Prior Publication Data

US 2006/0105880 A1 May 18, 2006

(30) Foreign Application Priority Data

Nov. 18, 2004 (FR) ..... 04 52679

(51) Int. Cl.
*H01H 9/24* (2006.01)

(52) U.S. Cl. ..... 200/17 R; 200/48 R; 218/154

(58) Field of Classification Search ..... 200/400, 200/401, 48 R, 48 A, 48 P, 49, 50.01, 17 R, 200/47; 218/7, 14, 78, 84, 154; 74/2, 584
See application file for complete search history.

(56) References Cited

U.S. PATENT DOCUMENTS 1,803,163 A 4/1931 Beebe
4,475,021 A * 10/1984 Mochizuki et al. ..... 200/400
5,938,008 A * 8/1999 Wehrli et al. ..... 200/400
6,160,234 A * 12/2000 Wehrli et al. ..... 200/400
6,285,147 B1 * 9/2001 Andersson ..... 318/280

FOREIGN PATENT DOCUMENTS

EP 1 271 588 A1 1/2003
EP 1 271 589 A1 1/2003
EP 1 465 222 A1 10/2004

* cited by examiner

*Primary Examiner*—Elvin Enad
*Assistant Examiner*—Marina Fishman
(74) *Attorney, Agent, or Firm*—Pearne & Gordon LLP

(57) ABSTRACT

A control device (10) for an electrical switchgear with three switching positions including a closed position, an open position and an earthing position. The switchgear includes a main shaft (14) and a drive shaft (28). The control device includes a mode selector lever (30) designed to select one operating mode among a motor driven switching mode, a manual switching mode between the open position and the closed position of the electrical switchgear, and a manual switching mode between the open position and the earthing position of the electrical switchgear. The mode selector lever has an opening with a curved contour, and the control device includes a cam disk (50) with a cam (54) capable of moving inside the opening (40). The control device may be applied to an isolating switch.

23 Claims, 8 Drawing Sheets

MECHANICAL CONTROL DEVICE FOR AN ELECTRICAL SWITCHGEAR WITH THREE SWITCHING POSITIONS, PROVIDED WITH A SELECTION LEVER COOPERATING WITH A CAM

RELATED APPLICATION

The present document claims priority to French patent application serial No. 04 52679 filed Nov. 18, 2004, which is hereby incorporated herein by reference.

TECHNICAL FIELD

This invention relates to the technical domain of mechanical control devices for switchgears with three switching positions, namely a closed position, an open position and an earthing position.

More particularly, the invention relates to a mechanical control device for a shielded switchgear with gas insulation, for example like a gas-insulated circuit breaker or isolating switch with three switching positions. The mechanical control device can be used to actuate this switchgear electrically or manually.

BACKGROUND OF THE INVENTION

Documents EP 1 271 588-A1 and EP 1 271 589-A1 disclose control devices for an isolating switch with three switching positions comprising a closed position, an open position and an earthing position, through which the isolating switch may be electrically or manually activated. The control devices comprise a main rotary shaft that will be coupled to the mobile contact of the isolating switch. This mobile shaft is rotated during switching operations, either by an electric motor or manually through a crank that is then coupled with a manual switching member connected in movement to the main shaft.

More precisely, these documents describe control devices for a three-position isolating switch, comprising two manual switching members, one which switches the isolating switch from its closed position to its open position or vice versa, and the other that switches the isolating switch from its open position to its earthing position or vice versa.

EP 1 271 588-A1 describes an isolating switch control in which a mechanism is integrated preventing some manual switching sequences of the isolating switch to satisfy the particular requirements of a user.

EP 1 271 589-A1 describes an isolating switch control also comprising a means of locking the rotary movement of the crank when the isolating switch reaches its open position from its closed position or from its earthing position.

Isolating switch control devices described in these two documents have disadvantages.

Firstly, these isolating switch control devices comprise an interlocking mechanism, for which the arrangement and the configuration can prevent some manual switching sequences of the isolating switch. For example, it is impossible to perform an earthing operation following a closing operation.

Furthermore, these isolating switch control devices comprise two separate openings into which the crank can be inserted to switch manually between the closed position and the open position, or between the open position and the earthing position. Each opening is provided with a coupling part that will mechanically connect the stop bolt to the control and a closing member to prevent the crank from being inserted into the opening when the switch is in a position preventing the corresponding operation. Each of these two openings is also provided with at least one bolt. It is difficult and expensive to duplicate these parts.

Furthermore, the interlocking mechanism of these isolating switch control devices is controlled by a secondary shaft that is driven by the main shaft through a bevel gear. However, there is a risk that the interlocking mechanism is in a position that does not correspond to the position of the main shaft, which can cause unwanted manual operations.

Consequently, there is a need for a mechanical control device for a switchgear with three switching positions without the disadvantages in control devices mentioned above.

SUMMARY OF THE INVENTION

The purpose of the invention is to propose a control device for an electrical switchgear with three switching positions, for example like an isolating switch, which does not have the disadvantages mentioned above.

According to the invention, the control device for an electrical switchgear with three switching positions of the type comprising the closed position, an open position and an earthing position, and comprising a main shaft and a drive shaft, is designed to be coupled to a mobile contact of said electrical switchgear. It comprises:

- a mode selector lever designed to select one operating mode among the <<motor driven switching mode >>, the <<first manual switching mode between the open position and the closed position of the electrical switchgear>> and the <<second manual switching mode between the open position and the earthing position of the electrical switchgear >>, said mode selector lever comprising an opening, and
- a cam disk fixed on the drive shaft, with a cam capable of moving inside said opening, such that the displacement of the cam disk is free when the control device is in the motor driven switching mode, limited to a first angular rotation range of the drive shaft when the control device is in the first manual switching mode, and limited to a second angular rotation range of the drive shaft when the control device is in the second manual switching mode.

The mode selector lever moves between:

- a neutral position in which the motor driven switching mode is selected, that may be reached for any angular position of the main shaft,
- a first extreme position, in which the first manual switching mode between the open position and the closed position of the electrical switchgear is selected, and that can be reached when the angular position of the main shaft is in a first angular range,
- a second extreme position, in which the second manual switching mode between the open position and the earthing position of the electrical switchgear is selected, and that can be reached when the angular position of the main shaft is in a second angular range.

The contour of the cam is substantially circular or elliptical or oval and has a centre of curvature that is coincident with the centre of curvature of the cam disk. It is connected to the cam disk by two connecting areas that define two circumferential noses.

The contour of the opening of the mode selector lever comprises two curved parts connected to each other by two intermediate portions, the curved portions and the intermediate portions being separated by connecting areas that define two connecting notches.

The control device comprises a transmission and interlocking disk fixed on the main shaft, said transmission and interlocking disk comprising a first part of the disk that is functionally connected to position indicating equipment, and a second part of the disk that cooperates with the mode selector lever to prevent it from being in the wrong position during displacement, as a function of the angular position of the main shaft.

The first part of the disk is fitted with teeth around its periphery, said teeth being designed to engage with the teeth in a control bar that is functionally connected to auxiliary switches and to a position indicator.

The second part of the disk comprises a slit substantially in the shape of two ring portions radially offset from each other and in communication with each other.

The connecting device comprises a spindle fixed to the mode selector lever that engages in said slit to prevent the mode selector lever from being in an incorrect position during its displacement as a function of the angular position of the main shaft.

The spindle extends substantially perpendicular from a face of the mode selector lever that is facing the transmission and interlocking disk.

The transmission and interlocking disk is driven by a driven disk supported on the main shaft, said driven disk itself being driven by a roller wheel fixed on the drive shaft, wherein the driven disk is provided with two recesses and two stop areas such that said driven disk and said roller wheel form a Geneva drive mechanism.

According to a first embodiment of the control device, the driven disk is rigidly fixed to the main shaft and drives the main shaft and the transmission and interlocking disk fixed on said main shaft.

According to a second embodiment of the control device, the driven disk has a degree of freedom in rotation about said main shaft and a degree of freedom in translation along said main shaft, the driven disk drives the transmission and interlocking disk, the driven disk being applied elastically in contact with the transmission and interlocking disk through a return means. Each of said driven disk and transmission and interlocking disk comprises corresponding holes that coincide so as to form cavities inside which balls are arranged. The combination of the transmission and interlocking disk, the driven disk, the return means, balls and holes forms a torque limiting mechanism.

In the same way as in the first embodiment and the second embodiment, rotation of the first cam disk is interrupted:

- either when the selector lever is in the first extreme position and the electrical switchgear is in the open position, since a first of the noses of the cam on the cam disk stops in contact with a first connecting notch of the opening in the mode selector lever,
- or when the mode selector lever is in the first extreme position and the electrical switchgear is in the closed position, since a first of the rollers of the wheel stops in contact with one of the stop areas of the driven disk during operation of the Geneva drive mechanism,
- or when the mode selector lever is in the second extreme position and the electrical switchgear is in the open position, since a second of the noses of the cam on the cam disk stops in contact with a second connecting notch of the opening of the mode selector lever,
- or when the mode selector lever is in the second extreme position and the electrical switchgear is in the earthing position, since a second of the rollers of the wheel stops in contact with the other of the stop areas of the driven disk during operation of the Geneva drive mechanism.

In the same way as in the first embodiment and the second embodiment, the control device comprises an actuation lever that is functionally connected to the mode selector lever, such that the motor driven switching mode or one of the two manual switching modes can be selected by positioning the actuation lever in one of the following three positions:

- a neutral position corresponding to the neutral position of the mode selector lever, through which the motor driven switching mode is selected,
- a first extreme position corresponding to the first extreme position of the mode selector lever, and through which the first manual switching mode between the open position and the closed position of the electrical switchgear is selected,
- a second extreme position corresponding to the first extreme position of the mode selector lever, and through which the second manual switching mode between the open position and the earthing position of the electrical switchgear is selected.

Displacement of the actuation lever causes displacement of a connecting rod that is connected to the mode selector lever and that controls displacement of the mode selector lever.

The actuation lever can pivot about a pivot shaft in a plane perpendicular to an auxiliary shaft.

The control device is functionally connected to a locking mechanism that comprises a locking lever rigidly fixed to the actuation lever and a stop bolt. The control device and the locking mechanism are arranged in a housing, such that the actuation lever and the stop bolt are arranged on the outside of a wall of said housing, while the locking lever is arranged on the inside of said wall of said housing.

The housing is also provided with a passage hole and the stop bolt is provided with a bolt stem. Subsequently:

- when the motor driven switching mode is selected, the locking lever is positioned facing the passage hole, so as to prevent the bolt stem or a manoeuvre member from coupling with the auxiliary shaft and enabling rotation of said auxiliary shaft, and
- when one of the manual switching modes is selected, the locking lever is positioned so as to release the passage hole, so that a bolt stem or a manoeuvre member can be coupled with the auxiliary shaft.

The stop bolt and the actuation lever are locked together in a position corresponding to the motor driven switching mode or in a position corresponding to either of the two manual switching modes, by means of a padlock with arms that pass through at least one locking hole in the actuation lever and at least one hole in the stop bolt. In this way, rotation of the auxiliary shaft is locked in one of the two manual switching modes.

Furthermore, the control device comprises at least one switching lever associated with the locking mechanism, said at least one switching lever being connected to additional switches themselves connected to the motor, to inform said motor about which switching mode is selected.

BRIEF DESCRIPTION OF THE DRAWINGS

The invention will be better understood after reading the following detailed description of embodiments of the invention given for illustrative purposes that is in no way limitative, with reference to the attached drawings, in which.

DETAILED PRESENTATION OF PARTICULAR EMBODIMENTS

Figure 1:
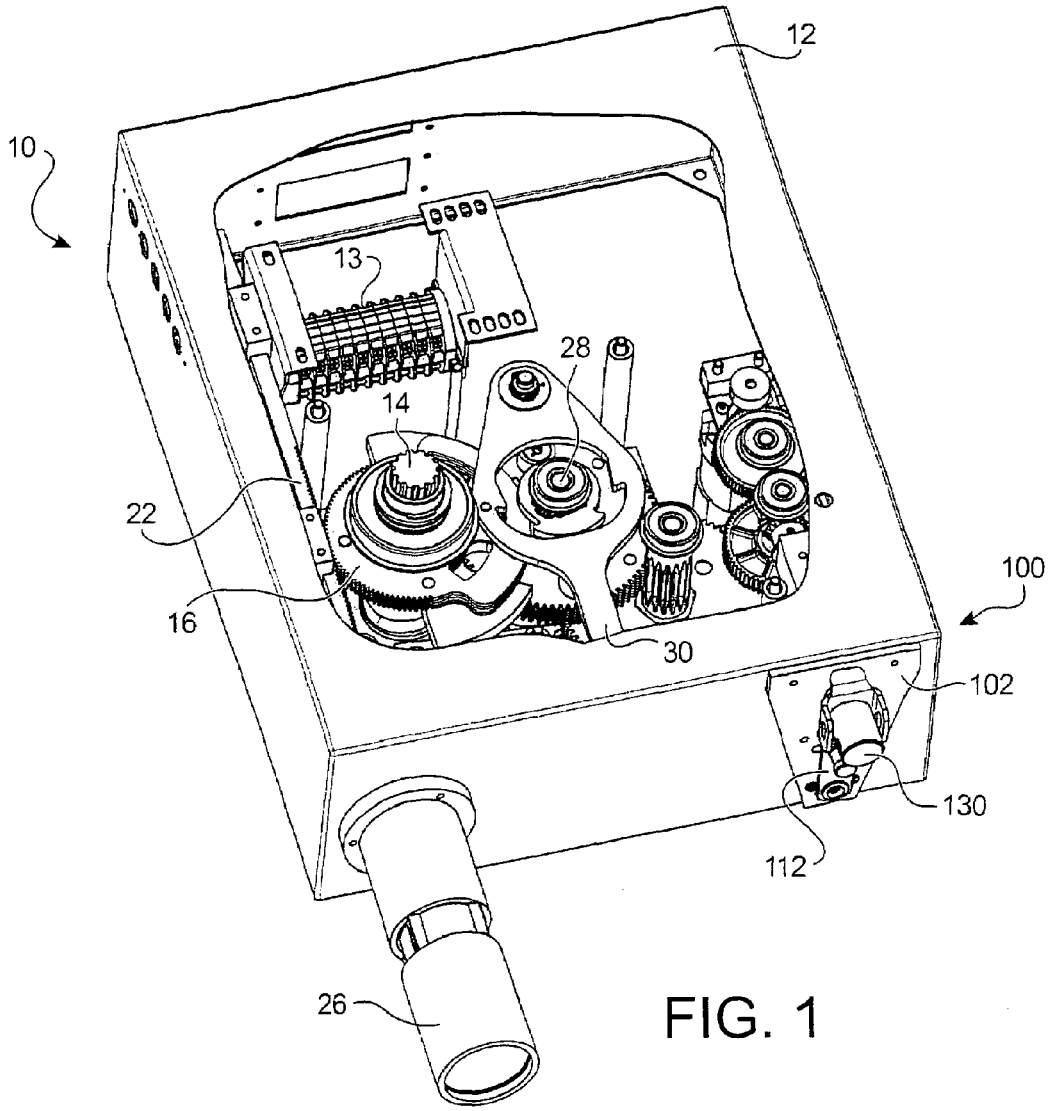
FIG. 1 is a perspective view from above showing a first embodiment of the control device and the locking mechanism arranged in a housing, the view including a cutout of the upper wall to show the connecting parts between the control device and the motor.
Figure 2:
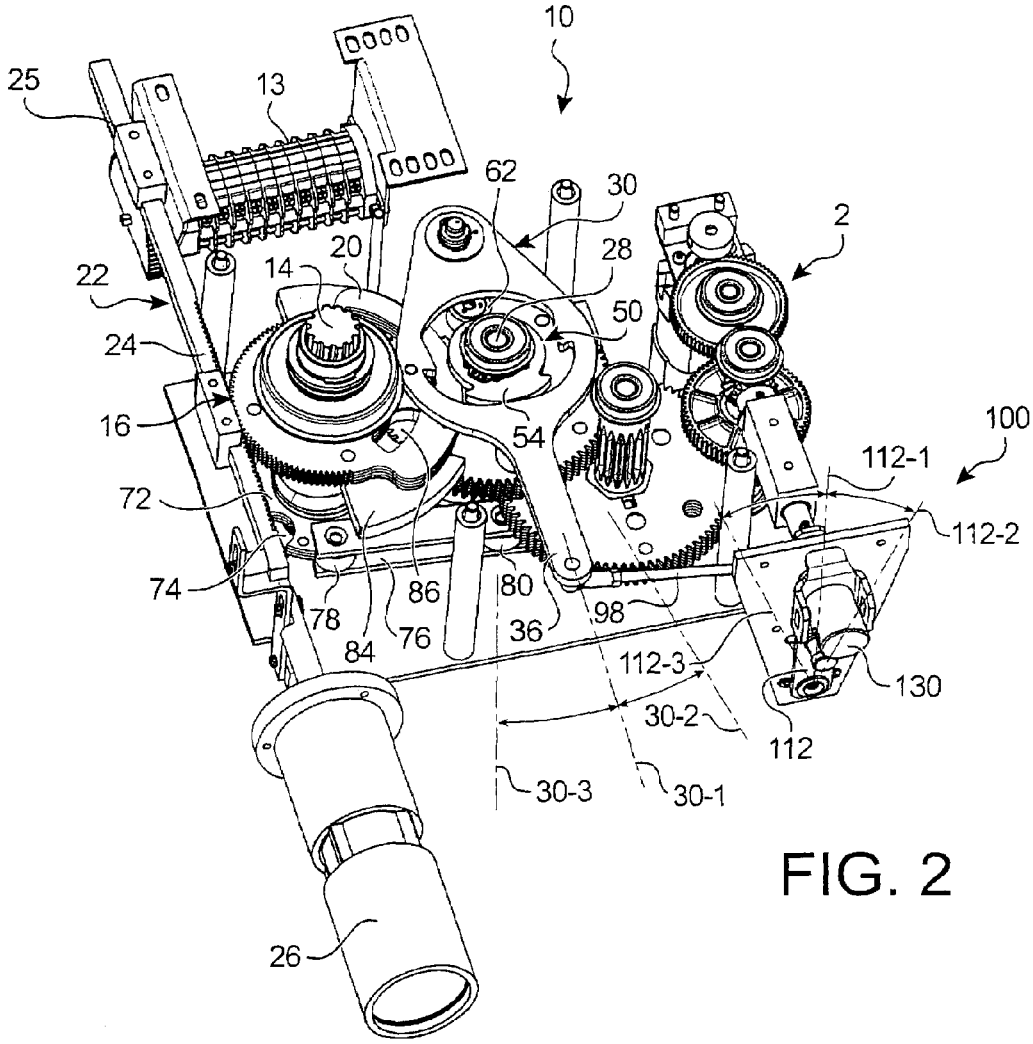
FIG. 2 is a view similar to FIG. 1, without the housing.

The first embodiment of the control device according to the invention will now be described. Referring firstly to FIGS. 1 and 2, the figures show a control device 10 for an electrical switchgear with a mobile contact that can be switched in three positions corresponding to opening, closing and earthing of the electrical switchgear.

The control device 10 is arranged inside a housing 12. It comprises a main rotating shaft 14 that will be coupled to the mobile contact (not shown) of the electrical switchgear.

In normal operation or motor driven switching mode, the main shaft 14 is driven by a motor 2 (shown in FIG. 2). This motor 2 is controlled by signals originating from auxiliary switches 13 and a master control equipment (not shown). The motor 2 stops operating as soon as one of the three positions of the electrical switchgear (open, closed or earthing) is reached.

More precisely, the control device 10 comprises a drive shaft 28 and an intermediate shaft 68, both parallel to the main shaft 14. The main shaft 14 supports a driven disk 84 driven by a wheel 60 supported on the drive shaft 28. This wheel 60 has a toothed periphery and is itself driven by a set of gears 4 supported by the intermediate shaft 68, this set of gears 4 being driven in rotation by the motor 2.

Figure 3:
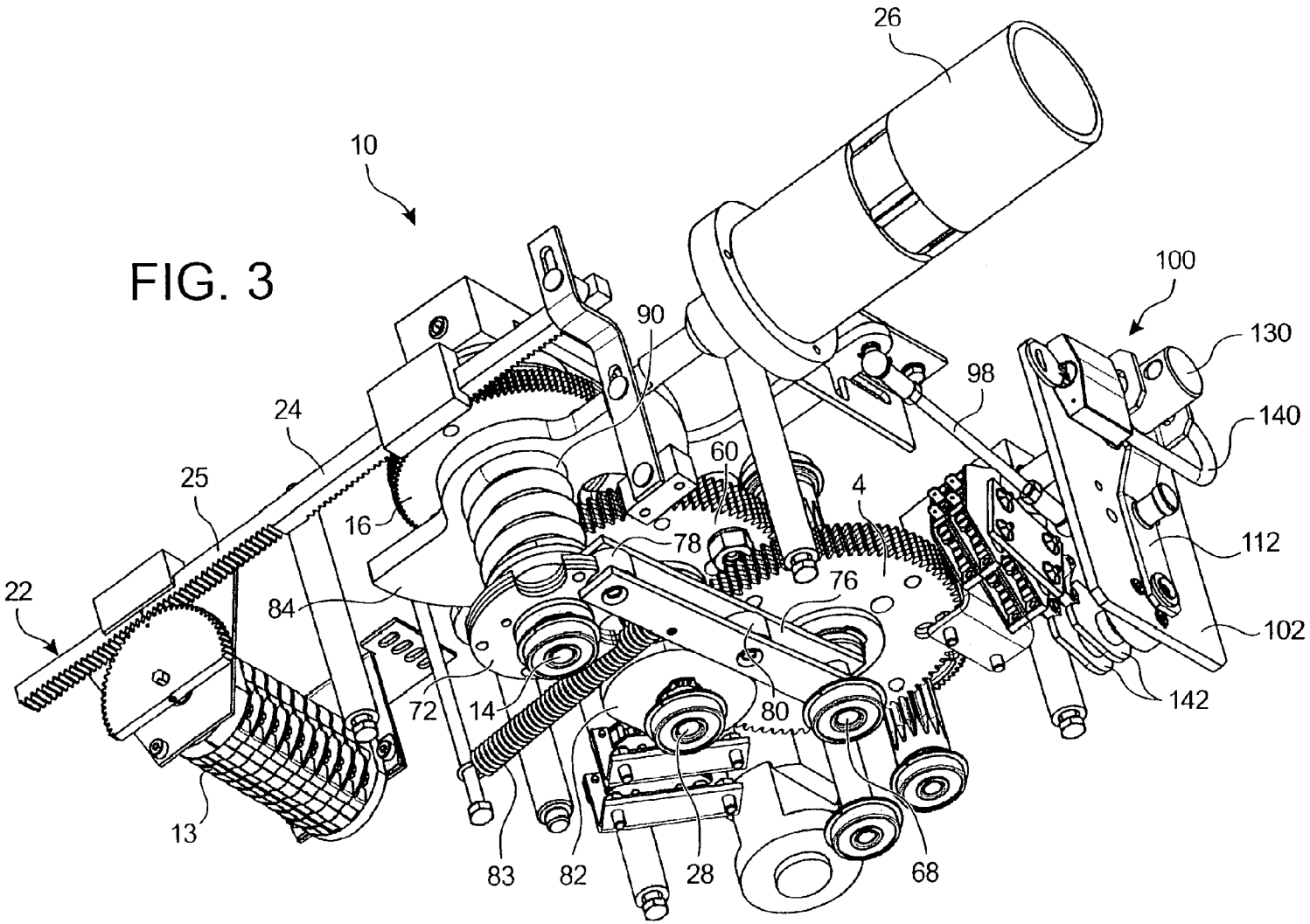
FIG. 3 is a perspective view from below showing the control device in FIG. 1, without the housing.

The wheel 60, visible in FIGS. 2 and 3, is rigidly fixed on the drive shaft 28. It comprises two wheel rollers 62, 63, that are rigidly fixed on a face of the wheel, diametrically opposite to each other.

Figure 12:
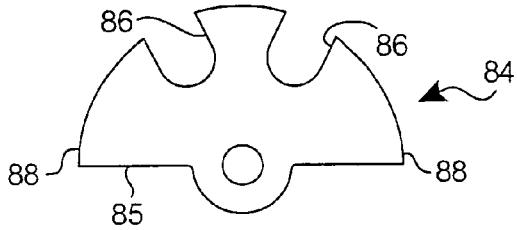
FIG. 12 shows a top view of the driven disk of the control device according to the first or the second embodiment.

The driven disk 84, shown in a top view in FIG. 12, is rigidly fixed onto the main shaft 14. It is substantially in the shape of a half-disk with a diametral edge 85. It is provided with two recesses 86 that are dimensioned and positioned such that each of them can hold one of the two wheel rollers 62, 63. It is also provided with two stop areas 88, each being positioned between one of the recesses 86 and the diametral edge 85. The contour of these stop areas 88 is substantially in the shape of the portion of a disk.

The wheel 60 and the driven disk 84 function together like a mechanism known as a <<Geneva drive mechanism>>. In other words, as the wheel 60 rotates, one or the other of the wheel rollers 62, 63 engages with one of the recesses 86 of the driven disk 84, and drives it in rotation along a path corresponding to a portion of a circle, and then it moves out of this recess 86.

In some circumstances, for example in the case of a power failure or an emergency, it is desirable that instead of being rotated under control of the motor 2, the main shaft 14 should be rotated under manual control.

To achieve this, the control device 10 may be used through a manoeuvre member that can be coupled to an auxiliary shaft 106. The control device 100 is provided with an actuation lever 112 placed in a position corresponding to a manual switching mode. This actuation lever 112 is functionally connected to a mode selector lever 30 cooperating with a first cam disk 50. The first cam disk 50 is supported by the drive shaft 28 that drives the main shaft 14 through the Geneva drive mechanism, in the same way as for the motor driven switching mode described above. The rotation movement of the main shaft 14 is limited by the first cam disk 50 cooperating with the mode selector lever 30 and by the stop areas 88 on the driven disk 84 cooperating with the rollers 62, 63 of the wheel 60. All these parts will be described with reference to FIGS. 2 to 4 and 8 to 11.

Figure 4:
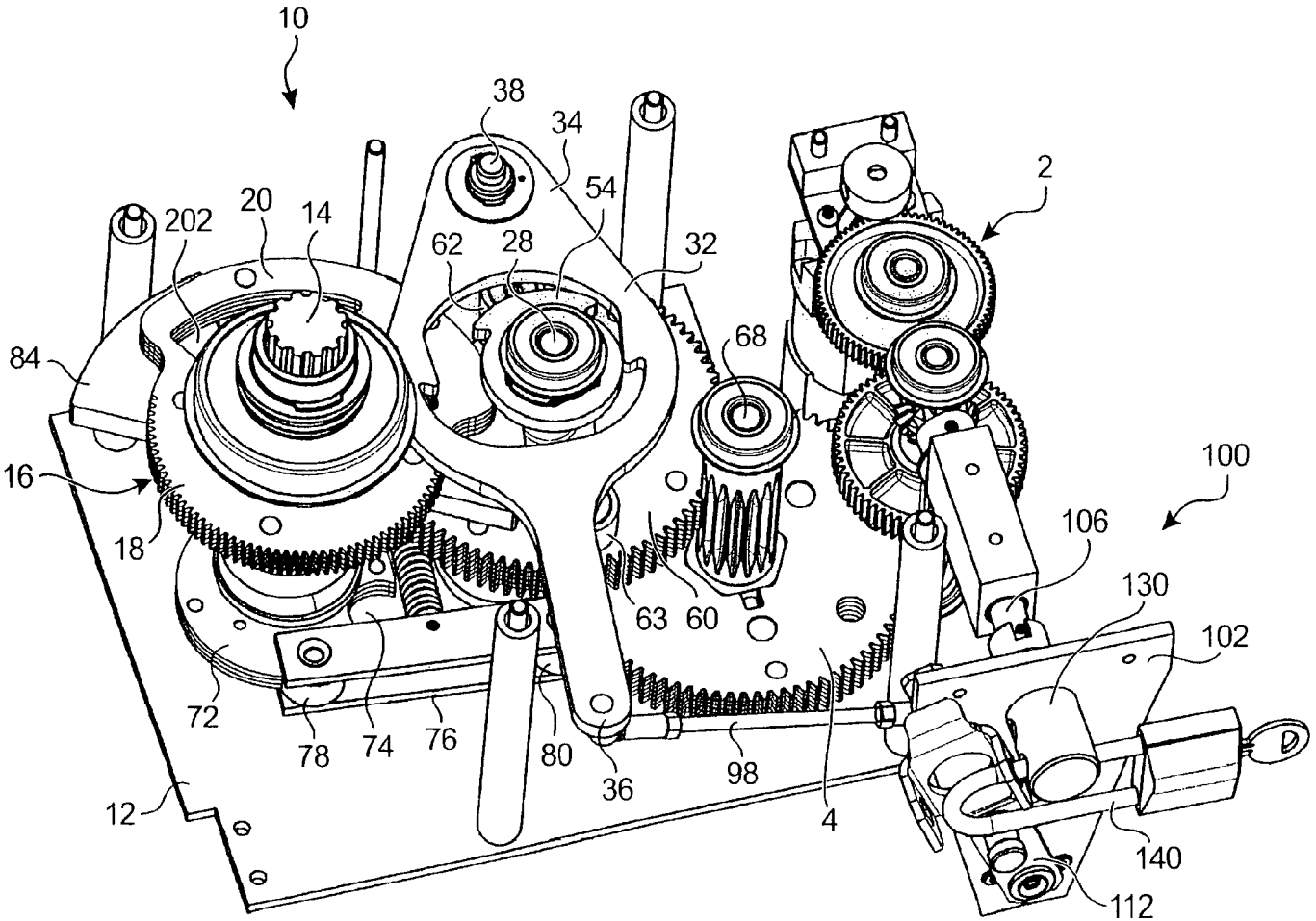
FIG. 4 shows a view similar to FIG. 3 at larger scale, not showing the connecting parts, showing the control device and the locking mechanism.

The actuation lever 112 shown in FIGS. 2 to 4 is actuated manually by an operator. It comprises a body having a shape substantially like an elongated plate. It is arranged outside the housing 12 parallel to a face of the housing. One of its ends is fixed on a pivot shaft 116 such that the actuation lever 112 can pivot around the pivot shaft 116 in a plan perpendicular to said pivot shaft 116.

As shown in FIG. 2, the angular displacement of the actuation lever 112 is defined inside an angular sector for which the limits define two extreme positions 112-2 and 112-3, and the median of which defines a neutral position 112-1.

The mode selector lever 30 is shown in FIGS. 2 and 4. It is substantially in the form of a plate with a substantially disk-like central body 32 with a first extension 34 prolonging the central body 32 and tapering substantially in the form of a triangle, and a second tail-like extension 36 prolonging the central body 32. The two extensions 34, 36 are diametrically on opposite sides of the central body 32.

The end of the first extension 34 comprises a hole 35 through which a rotation rod 38 passes, itself rigidly fixed to the housing 12, such that the mode selector lever 30 is free to rotate around this rotation rod 38 in a plane perpendicular to the main shaft 14 and to the drive shaft 28.

The end of the second extension 36 is connected free to rotate to a first end of a connecting rod 98 itself functionally connected to the actuation lever 112. When the connecting rod 98 acts on the end of the second extension 36, the mode selector lever 30 is moved in rotation about the rotation rod 38. As shown in FIG. 2, the angular displacement of the mode selector lever 30 is defined inside an angular sector, the limits of which define two extreme positions 30-2 and 30-3, and the median of which defines a neutral position 30-1.

The angular displacement of the mode selector lever 30 is triggered by a translation of the connecting rod 98 along the axial direction of the connecting rod, this translation itself being provoked by an angular displacement of the actuation lever 112 about its pivot shaft. Thus, the correspondence between the angular displacements of the actuation lever 112 and the mode selector lever 30 in the example shown on the figures, and more particularly in FIG. 2, is as follows:

- when the actuation lever 112 is in its neutral position 112-1, the mode selector lever 13 is in its neutral position 30-1, and the motor driven switching mode is selected,
- when the actuation lever 112 is in its first extreme position 112-2, the mode selector lever 30 is in its first extreme position 30-2 to the right of the neutral position 30-1 in FIG. 2, and the first manual switching mode between the open position and the closed position of the electrical switchgear is selected,
- when the actuation lever 112 is in its second extreme position 112-3, the mode selector lever 30 is in its second extreme position 30-3 to the left of the neutral position 30-1 in FIG. 2, and the second manual switching mode between the open position and the earthing position of the electrical switchgear is selected.

Figure 9:
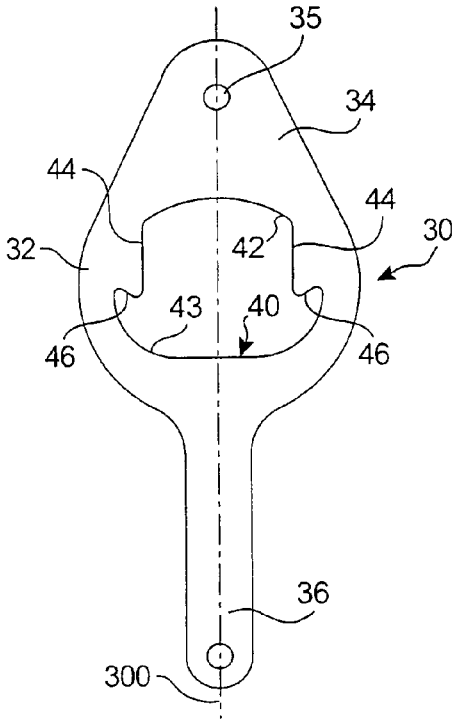
FIG. 9 shows the top view of the mode selector lever of the control device according to the first or second embodiment.

The mode selector lever 30 shown in a top view in FIG. 9 is provided with an opening 40 formed in the substantially disk-shaped central body 32. This opening 40 is a through opening in the example shown. It has a curved contour, with two curved portions 42, 43 substantially following a portion of a circle or a portion of an ellipse or a portion of an oval or a combination of these shapes. The two curved portions are arranged with one facing the first triangular-shaped extension 34 and the other facing the second tail-like extension 36. The two curved portions 42, 43 are connected to each other through two intermediate portions 44 that extend inside the opening 40 so as to interrupt the circular or elliptical or oval line defined by the two curved portions. The two connecting areas between the two intermediate portions 44 and the curved portion 43 located facing the second extension 36 define connecting notches 46 in the contour of the opening 40.

When the mode selector lever 30 is in the neutral 30-1, the opening 40 is substantially centred about the drive shaft 28.

The mode selector lever 30 also comprises a spindle 48 arranged on the intermediate portion 44 that is on the side of the main shaft 14. This spindle 48 that can be seen in FIG. 5, extends substantially perpendicular to the central body 32 of the mode selector lever 30, starting from one face of this lever.

Figure 10:
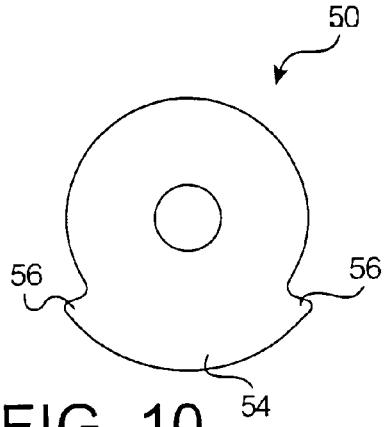
FIG. 10 shows a top view of the cam disk of the control device according to the first or the second embodiment.
Figure 11:
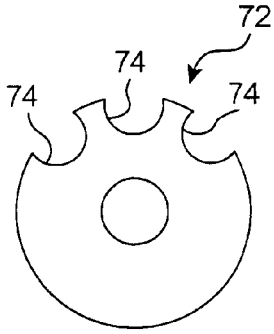
FIG. 11 shows the top view of the recessed disk of the control device according to the first or the second embodiment.

The control device 10 also comprises a first cam disk 50 shown in a top view in FIG. 10, with a protuberance forming a cam 54. The cam 54 has a substantially circular or elliptical contour with a centre of curvature coincident with the centre of curvature of the disk 50. The two connecting areas between the contour of the disk 50 and the contour of the cam 54 define two circumferential noses 56.

The first cam disk 50 is rigidly fixed to the drive shaft 28 facing the face of the wheel 60 on which the two wheel rollers 62, 63 are located. The two circumferential noses 56 are arranged symmetrically on each side of the diameter of the wheel 60 on which the two wheel rollers 62, 63 are placed.

The first cam disk 50 is substantially at the same level as the mode selector lever 30 with respect to the drive shaft 28. The dimension of the first cam disk 50, in other words the diameter of the disk plus the width of the cam 54, is less than the largest dimension of the opening 40. The result is that the opening 40 of the mode selector lever 30 surrounds the first cam disk 50.

Figure 8:
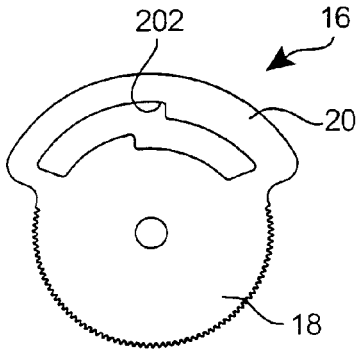
FIG. 8 shows a top view of the transmission and interlocking disk of the control device according to the first or the second embodiment.

The transmission and interlocking disk 16 shown in a top view in FIG. 8 is rigidly fixed to the main shaft 14. It comprises a first disk part 18 with a toothed periphery that meshes with a first toothed linear part 24 of the control bar 22, thus forming a bevel gear. The control bar 22 comprises a second toothed linear part 25 that meshes with the auxiliary switches 13. One of the ends of the control bar 22 passes outside the housing 12. A position indicator 26 is rigidly fixed to this end of the control bar 22, so that it is visible outside the housing 12.

The transmission and interlocking disk 16 comprises a second disk part 20, not toothed, with a diameter greater than the diameter of the first disk part 18.

In the example shown in the figures, the transmission and interlocking disk 16 is sized such that each of the two disk parts 18, 20 corresponds substantially to half of the disk. The second part of the disk 20 comprises a through slit 202 substantially in the form of two ring portions radially offset from each other, and that are connected through a substantially straight intermediate portion in the radial direction. During operation, this slit 202 will hold the spindle 48 of the mode selector lever 30.

The control device 10 also comprises a recessed disk 72 rigidly fixed to the main shaft 14 and cooperating with a roller lever 76. This recessed disk 72 is shown in a top view in FIG. 11. It comprises three recesses 74 substantially in the shape of the portion of a circle opening up on its periphery. In the example shown, all three of the recesses 74 are in the same half of the recessed disk 72.

The roller lever 76 that is entirely visible in FIG. 3, is substantially in the form of a rod with two elongated straight and parallel plates. One of the ends of the roller lever 76 is connected to the intermediate shaft 68 so that it can rotate freely about it. At the other of its ends, the roller lever 78 is fitted with a first roller 78 arranged between the two plates and free to rotate about an axis perpendicular to the two plates and connecting them together. Between its two ends, the roller lever 76 is provided with a second roller 80 arranged between the two plates and free to rotate about an axis perpendicular to the two plates and connecting them together. The rotation axes of the two rollers 78, 80 are perpendicular to the direction of the roller lever 76. The second roller 80 cooperates with a second cam disk 82 supported on the drive shaft 28 and with a return spring 83 that acts to hold the second roller 80 in contact with the second cam disk 82. The second cam disk 82 is substantially in the shape of a rectangle with rounded corners, such that when the second roller 80 moves in contact with the second cam disk 82, the roller lever 76 is driven by an angular movement about the intermediate shaft 68. The length of the roller lever 76, the diameters and positions of the first and second rollers 78, 80 are such that the first roller 78 can engage with one of the recesses 74 of the recessed disk 72 and move out of it during movement of the roller lever 76.

In the example shown in the figures, the driven disk 84 is arranged between the transmission and interlocking disk 16 and the recessed disk 72 along the main shaft 14. The driven disk 84, which is in the form of a half-disk, is arranged so that it is substantially facing the second part of the disk 20 of the transmission and interlocking disk 16. A compression spring 90 pushes the driven disk 84 in contact with the transmission and interlocking disk 16 so as to maintain contact between these two disks (FIG. 3). The presence of this compression spring 90 is optional for the first embodiment, to the extent that the two disks 16, 84 are rigidly fixed to the main shaft 14.

Now will be described operation of the control device 10 according to the first embodiment, with reference to FIGS. 2, 2A, 3 and 4.

Figure 2A:
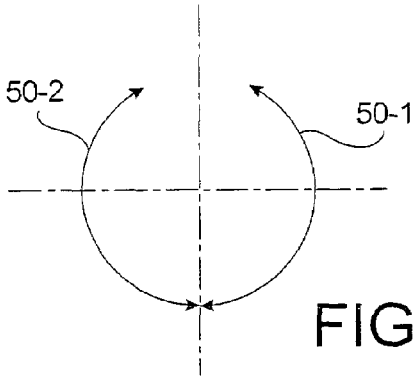
FIG. 2A is a diagram showing a top view of the rotational displacement of the first cam disk of the control device.

We will denote the first angular rotation range of the first cam disk 50 as the angular range denoted by 50-1 in FIG. 2A, and the second angular rotation range of the first cam disk 50 as the angular range denoted by 50-2 in FIG. 2A.

As mentioned above, when the actuation lever 112 is manually positioned in its neutral position 112-1, the mode selector lever is in its neutral position 30-1, and the motor driven switching mode of the electrical switchgear is selected. The motor 2 drives the set of gears 4 that drives the wheel 60 of the Geneva drive mechanism. The drive shaft 28 is fixed to this wheel 60. Consequently, the first cam disk 50 rigidly fixed to the drive shaft 28 is rotated at the same time as the wheel 60. This first cam disk is free to rotate, the cam 54 being free to rotate inside the opening 40 of the mode selector lever 30 for the neutral position 30-1 of this lever. Secondly, during rotation of the wheel 60, one of the rollers 62, 63 of this wheel 60 engages with one of the recesses 86 in the driven disk 84. Consequently, the driven disk 84 is driven in rotation, together with the main shaft 14 to which it is rigidly fixed.

The operator can decide to position the actuation lever 112 manually in its first extreme position 112-2 or in its second extreme position 112-3. In this case, a manoeuvre member for example such as a crank, may be coupled with an auxiliary shaft 106 that then drives the set of gears 4 in a manner similar to how this set of gears 4 is driven by the motor 2 when motor driven switching mode is selected.

When the actuation lever 112 is in its first extreme position 112-2 or in its second extreme position 112-3, the mode selector lever 30 is in its first extreme position 30-2 or its second extreme position 30-3 respectively, and one of the two manual switching modes of the electrical switchgear is selected. These two situations are described below.

When the mode selector lever 30 is in the first extreme position 30-2, the first manual switching mode is selected corresponding to switching between the open position and the closed position of the electrical switchgear.

The drive shaft 28 rotates. It lifts the roller lever 76. It drives the first cam disk 50 in rotation and this cam disk rotates through approximately 200 degrees within the first angular rotation range 50-1 of the cam disk 50, which corresponds to a rotation of substantially 60 degrees of the main shaft 14. The electrical switchgear is then in the open position or in the closed position or in an intermediate position between the two. This angular range 50-1 is bounded on each side:

- firstly, rotation of the first cam disk 50 is interrupted when the electrical switchgear is in the open position, since a first of the noses 56 of the cam 54 stops in contact with a first of the connecting notches 46 of the opening 40 of the mode selector lever 30,
- secondly, rotation of the first cam disk 50 is interrupted when the electrical switchgear is in the closed position, even if this first cam disk 50 could rotate by about another 20 degrees in this direction, since one of the rollers 62, 63 of the wheel 60 stops in contact with one of the stop areas 88 of the driven disk 84 during operation of the Geneva drive mechanism.

When the motor selector lever 30 is in the second extreme position 30-3, the second manual switching mode is selected, corresponding to switching between the open position and the earthing position of the electrical switchgear.

The drive shaft 28 rotates. It lifts the roller lever 76. It drives the first cam disk 50 in rotation that rotates through approximately 200 degrees within the second angular rotation range 50-2 of the cam disk 50, corresponding to a rotation of the main shaft 14 equal to about 60 degrees. The electrical switchgear is then in the open position or in the earthing position or in an intermediate position between the two. The angular range 50-2 is bounded on each side:

- firstly, rotation of the first cam disk 50 is interrupted when the electrical switchgear is in the open position, since a second of the noses 56 of the cam 54 stops in contact with a second of the connecting notches 46 of the opening 40 of the mode selector lever 30,
- secondly, rotation of the first cam disk 50 is interrupted when the electrical switchgear is in the earthing position, even if this first cam disk 50 could rotate by about another 20 degrees in this direction, since a second of the rollers 62, 63 of the wheel 60 stops in contact with one of the stop areas 88 of the driven disk 84 during operation of the Geneva drive mechanism.

The following characteristics must be recorded in each of the two situations that have just been described, namely manual switching mode from the open position to the closed position of the electrical switchgear and manual switching mode from the open position to the earthing position of the electrical switchgear.

Firstly, when one of the rollers 62, 63 of the wheel 60 stops in contact with one or the other of the stop areas 88 of the driven disk 84, the roller 78 of the roller lever 76 engages with one of the recesses 74 in the recessed disk 72, to prevent free rotation of the main shaft 14, since neither of the two rollers 62, 63 of the wheel 60 is then engaged in one of the recesses 86 in the driven disk 84.

The angular position of the two connecting notches 46 of the opening 40 in the mode selector lever 30 controls operation of the Geneva drive mechanism consisting of the wheel 60 and the driven disk 84. This angular position of the connecting notches 46 is chosen such that rotation of the cam disk 50 is interrupted in both of the angular ranges 50-1 and 50-2, by one of the noses 56 engaging in one of the connecting notches 46 just before one of the two rollers 62, 63 of the wheel 60 comes into contact with one of the recesses 86 of the driven disk 84. In this way, the Geneva drive mechanism is stopped if the main shaft 14 is in its neutral position. The electrical switchgear is then in its open position.

The shape of these connecting notches 46 is also chosen such that when rotation of the first cam disk 50 is interrupted by one of the noses 56 engaging with one of the connecting notches 46, the resulting force is in the direction towards the centre of the hole 35 of the mode selector lever 30.

Finally, the transmission and interlocking disk 16 is intended to limit rotation of the mode selector lever 30 so that it cannot be incorrectly positioned when it is moved manually by an operator using the actuation lever 112 and the connecting rod 98. In other words, the mode selector lever 30 cannot be moved towards its first extreme position 30-2 unless the mobile contact of the electrical switchgear is in the open position or in the closed position or in an intermediate position between the two. Similarly, the mode selector lever 30 cannot be moved towards its second extreme position 30-3 unless the mobile contact of the electrical switchgear is in the open position or in the earthing position or in an intermediate position between the two. This displacement of the mode selector lever 30 is limited by means of the spindle 48 that extends from the face of the mode selector lever facing the transmission and interlocking disk 16, and that moves in the slit 202 in this transmission and interlocking disk 16 during displacement of the mode selector lever 30. When the mode selector lever 30 is in its neutral position 30-1, the spindle 48 slides in the intermediate straight portion of the slit 202. When the mode selector lever 30 is between its neutral position 30-1 and its first extreme position 30-2, the spindle 48 slides in one of the ring portions of the slit 202. And when the mode selector lever 30 is between its neutral position 30-1 and its second extreme position 30-3, the spindle 48 is in the other of the ring portions of the slit 202. The dimensions of the slit 202 are chosen to enable such displacement of the spindle 48.

Figure 5:
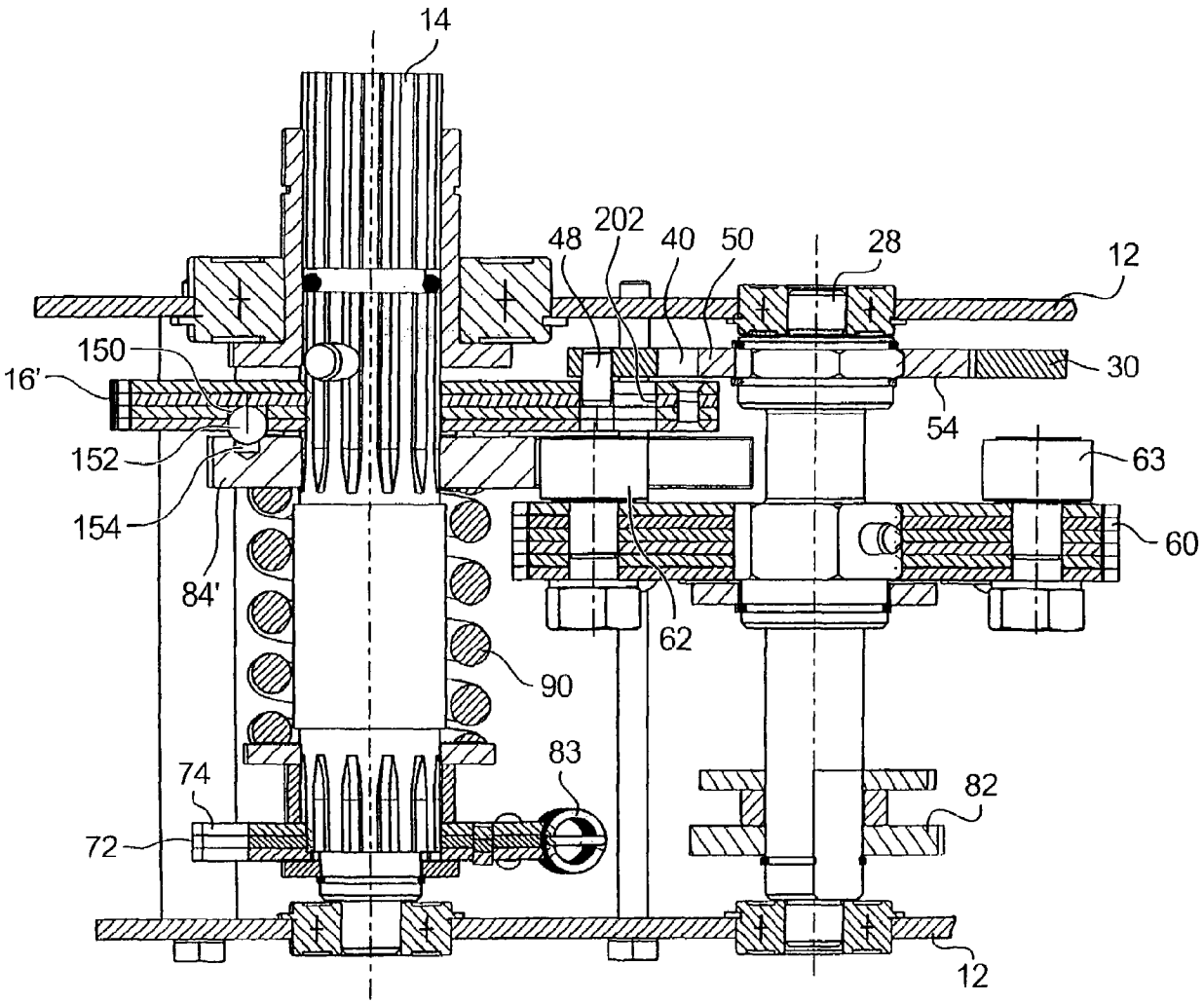
FIG. 5 shows a sectional elevation view of a second embodiment of the control device, in which the control device is fitted with a torque limiting mechanism.

Now will be described the second embodiment of the control device 10' according to the invention with reference to FIG. 5, which is a sectional and elevation view of the control device 10'. In particular, like the control device 10 according to the first embodiment, this control device comprises a main shaft 14, a drive shaft 28 parallel to the main shaft 14, a mode selector lever 30 acting on a first cam disk 50 fixed to the drive shaft 28, a Geneva drive mechanism consisting of a wheel 60 with two rollers 62, 63 and a driven disk 84'.

The control device 10' according to the second embodiment is different from the control device 10 according to the first embodiment in that the driven disk 84' is not rigidly fixed to the main shaft 14, but has a degree of freedom in rotation about this main shaft 14, and a degree of freedom in translation along the main shaft 14.

The control device 10' according to the second embodiment is also different from the control device 10 according to the first embodiment in that the transmission and interlocking disk 16' is provided with interlocking holes 150 on its face facing the driven disk 84', the holes opening up on said face and having a substantially cylindrical shape, and inside which balls 152 are placed. The depth of the interlocking holes 150 is such that the balls 152 project from the transmission and interlocking disk 16'.

The control device 10' according to the second embodiment is also different from the control device 10 according to the first embodiment in that the driven disk 84' is provided with driven holes 154 on its face facing the transmission and interlocking disk 16', the holes opening up on said face and having a substantially cylindrical shape, their diameter being significantly less than the diameter of the interlocking holes 150.

The interlocking holes 150 of the transmission and interlocking disk 16' and the driven holes 154 of the driven disk 84' are positioned such that they can be located facing each other for a given relative angular position of the transmission and interlocking disk 16' and the driven disk 84'. A compression spring 90 pushes the driven disk 84' into contact with the transmission and interlocking disk 16'. The compression force of the compression spring 90 is calibrated for a given torque.

According to one preferred embodiment, there are eight interlocking holes 150, eight balls 152 and eight driven holes 154.

Therefore according to this second embodiment, the torque is transmitted directly from this driven disk 84' to the transmission and interlocking disk 16', instead of being transmitted through the main shaft 14. The driven disk 84' is applied in contact with the transmission and interlocking disk 16' by the compression spring 90 forming the return means. Thus, the presence of balls 152 trapped in the cavities formed by the driven holes 150 and the interlocking holes 154 provides a means of fixing the transmission and interlocking disk 16' and the driven disk 84' together.

In the case of a malfunction, for example if the mobile contact of the electrical switchgear is locked, the torque transmitted from the driven disk 84' to the transmission and interlocking disk 16' exceeds the value of the torque corresponding to the compression force of the compression spring 90, which then no longer applies the driven disk 84' in contact with the transmission and interlocking disk 16. The driven disk 84' moves in the axial direction along the main shaft 14 moving away from the transmission and interlocking disk 16', and the balls 152 move out of the driven holes 154 of the driven disk 84'. This results in decoupling between the driven disk 84' and the transmission and interlocking disk 16.

With this arrangement, the elements that control or indicate the position of the isolating switch, in other words the position indicator 26, the slit 202 in the transmission and interlocking disk 16' and the auxiliary switches 13 can be in an appropriate switching position of the electrical switchgear, even in the case of a malfunction.

Furthermore, this arrangement satisfies the requirements of IEC (International Electrotechnical Commission) standard No. 129, according to which the weakest element of the kinematic chain starting from the motor as far as the mobile contact, must be located between the motor and the position indicator elements.

The transmission and interlocking disk 16' that has just been described with reference to the second embodiment of the control device 10', like the first embodiment, has functions to drive the position indicator 26 by means of the first toothed part of the disk 18, and the function to limit the displacement of the mode selector lever 30 by means of the slit 202. It also performs the function of a torque limiter, by means of the balls 152. This torque limiter is arranged close to the Geneva drive mechanism.

We will now describe the locking mechanism 100 with reference to FIGS. 2, 3, 4, 6 and 7. Although the locking mechanism 100 is only shown on the figures with the first embodiment of the control device 10, it can also be used with the second embodiment of the control device 10'.

The locking mechanism 100 is actuated manually. It is designed to prevent manual switching modes when the motor driven switching mode is used and to prevent motor driven switching mode when one of the two manual switching modes is used. The configuration of the control device 10, 10' and the locking mechanism 100 assembly is such that the mode selector lever 30 is located between the main shaft 14 and the locking mechanism 100.

The locking mechanism 100 comprises a plate 102 fixed on a sidewall of the housing 12.

A passage hole 104 is drilled in the plate 102. An auxiliary shaft 106 is arranged inside the housing 102 such that one of its ends is facing the passage hole 104 at a certain distance from it. The direction of the auxiliary shaft 106 is substantially perpendicular to the direction of the main shaft 14. At its other end, the auxiliary shaft 106 is slid inside a support 108 in which it can rotate about its own axis.

An axle hole 110 is also drilled in the plate 102, positioned such that the straight line between the passage hole 104 and the axle hole 110 is substantially parallel to the direction of the main shaft 14 in the example shown. Firstly the actuation lever 112, then a locking lever 114 and two switching levers 142 are fixed on the pivot shaft 116 that passes through the shaft hole 110 such that the plate 102 is inserted between the actuation lever 112 and the locking lever 114. Thus, the actuation lever 112 and the locking lever 114 can pivot together about the pivot shaft 116 parallel to and on each side of the plate 102.

The locking lever 114 is connected to the second end of the connecting rod 98, the other end of the connecting rod 98 being connected to the mode selector lever 30 as described above. Thus, pivoting of the locking lever 114 causes translation of the connecting rod 98 along the axial direction of the connecting rod, substantially perpendicular to the straight line between the passage hole 104 and the axle hole 110 and to the direction of the main shaft 14. Thus, the actuation lever 112 is functionally connected to the mode selector lever 30 so as to control displacement of the mode selector lever. The actuation lever 112 is moved manually. When the actuation lever 112 is moved from its neutral position 112-1 to its first extreme position 112-2, the mode selector lever 30 is moved from its neutral position 30-1 to its first extreme position 30-2. Similarly, when the actuation lever 112 is moved from its neutral position 112-1 to its second extreme position 112-3, the mode selector lever 30 is moved from its neutral position 30-1 to its second extreme position 30-3.

The actuation lever 112 is substantially in the shape of an elongated plate. A lever hole 118 is drilled in its free end with a diameter substantially equal to the diameter of the passage hole 104. It also comprises two extension tabs 120 extending at its free end, substantially perpendicular to the plane of the elongated plate, on the same side of this plate. When the actuation lever 112 is installed with one of its faces facing the plate 102, the two extension tabs 120 are located on the face opposite this face facing the plate 102.

Figure 7:
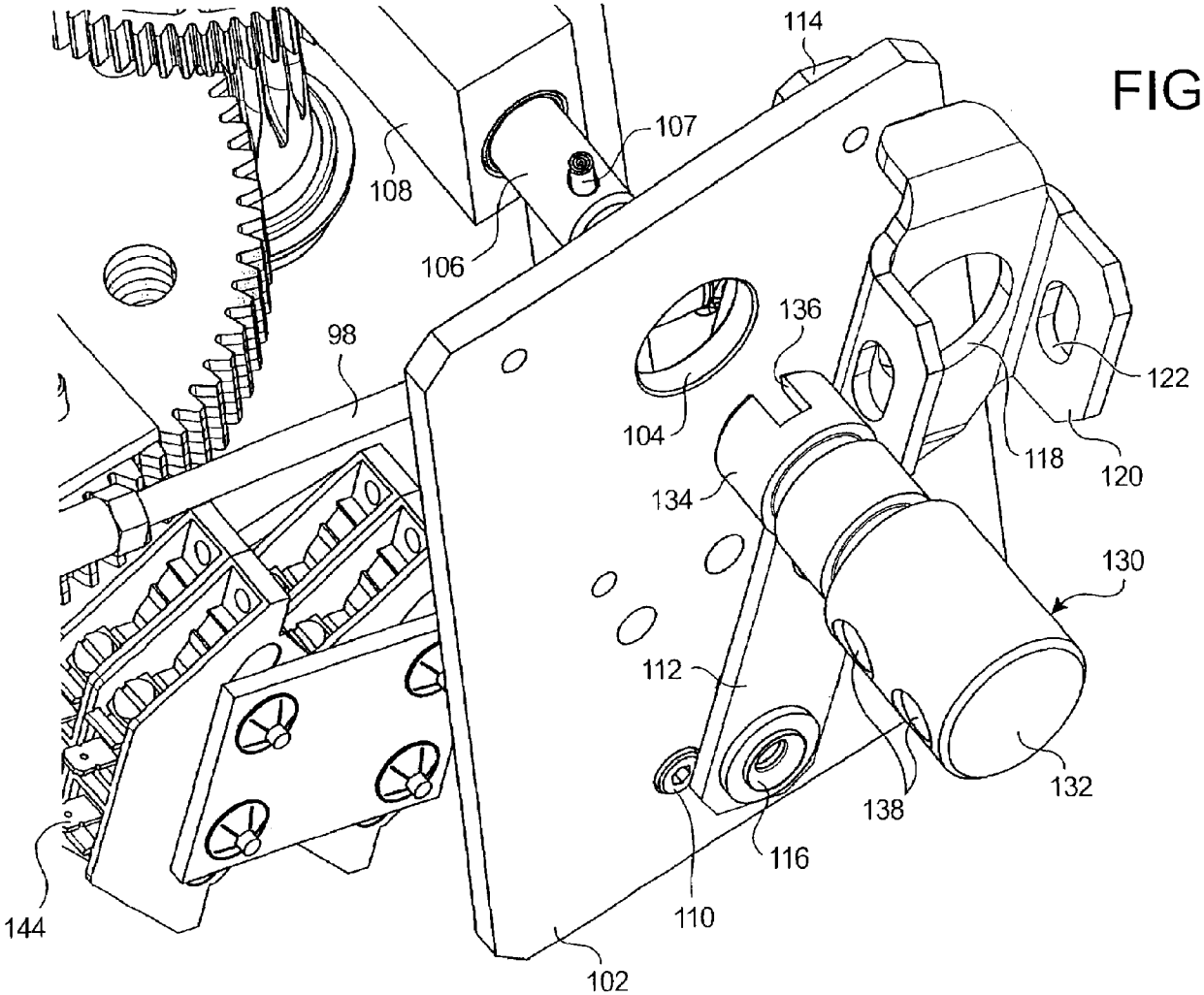
FIG. 7 is a view similar to FIG. 6, one of the parts being separated from the rest of the mechanism, to facilitate understanding.

A locking hole 122 is drilled in each of the two extension tabs 120, these two locking holes 122 being arranged facing each other along a direction perpendicular to the direction of the elongated plate (FIG. 7).

The locking mechanism 100 also comprises a stop bolt 130 with a bolt head 132 and a bolt stem 134. In the example shown, the bolt head 132 and the bolt stem 134 are substantially cylindrical in shape with circular sections centred on the same axle. The diameter of the bolt head 132 is sufficiently small so that the bolt head 132 can be placed between the two extension tabs 120 of the actuation lever 112. The diameter of the bolt head 132 is sufficiently large so that the bolt head 132 cannot pass through the passage hole 104.

Figure 6:
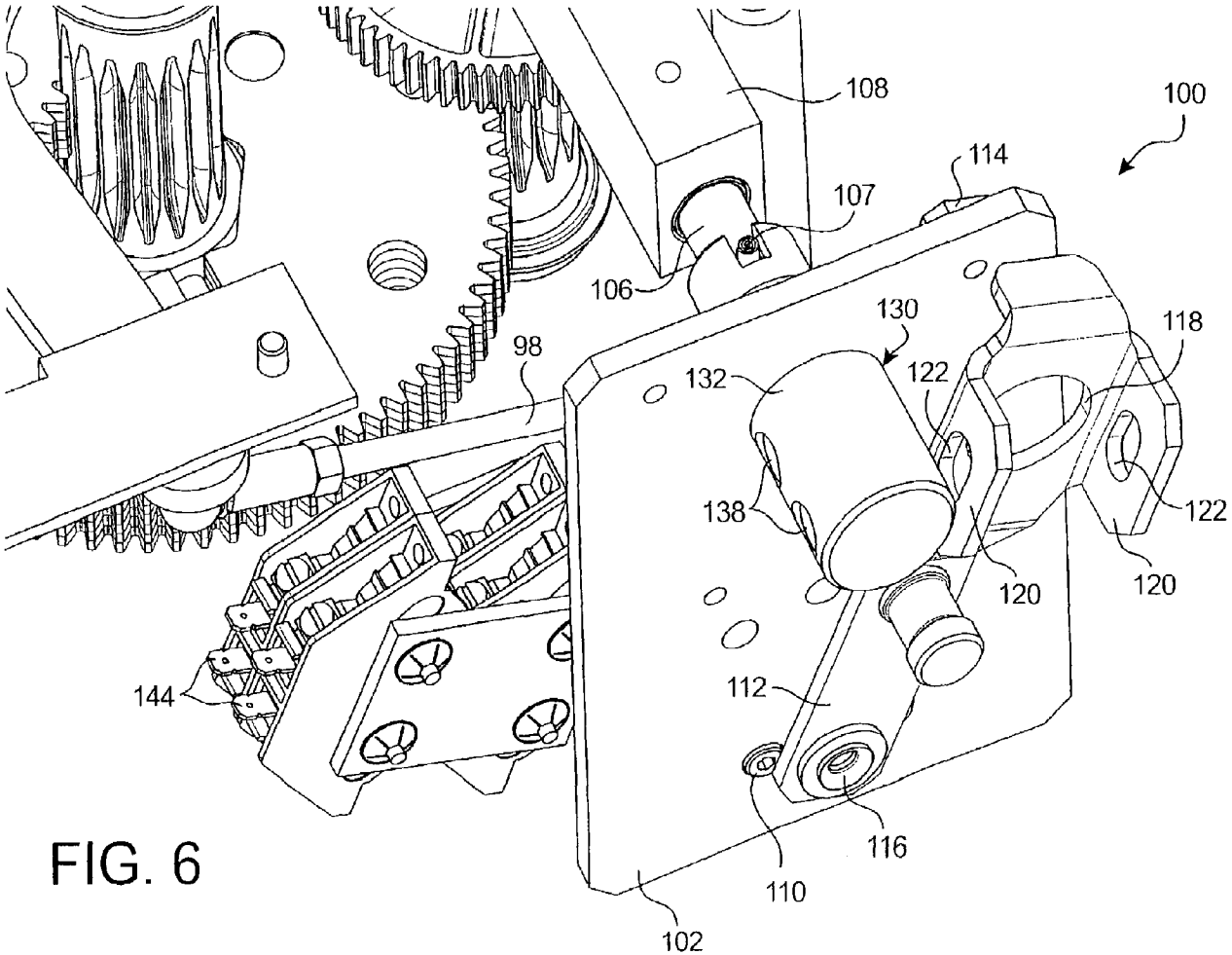
FIG. 6 shows a view similar to FIG. 3 at larger scale, not showing the connecting parts, and showing the locking mechanism in another operating position.

The bolt stem 134 is hollow, and it can engage on the free end of the auxiliary shaft 106, passing through the passage hole 104 and moving along the distance separating the free end of the auxiliary shaft 106 from the plate 102, for some positions of the actuation lever 112, as will be explained later. The end of the bolt stem 134 comprises two notches 136, arranged so as to be diametrically opposite each other, that will cooperate with two pins 107 arranged on the free end of the auxiliary shaft 106, being diametrically opposite each other. Consequently, when the bolt stem 134 is engaged on the free end of the auxiliary shaft 106, the notches 136 and the pins 107 form locking means that fix the stop bolt 130 and the auxiliary shaft 106 together (FIGS. 6 and 7). Consequently, the auxiliary shaft 106 is prevented from turning when the stop bolt 130 is immobilised, for example by a padlock 140.

The bolt head 132 comprises one or several stop bolt holes 138 (two in example shown). These stop bolt holes 138 are parallel to each other and pass diametrically through the bolt head 132, in other words perpendicular to the direction of the bolt stem 134 (FIG. 7).

The stop bolt hole(s) 138 and the locking holes 122 will contain the arms of a padlock 140, or a similar interlocking means, to interlock the stop bolt 130 and the actuation lever 112, in one of the three possible positions 112-1, 112-2, 112-3 of the actuation lever 112 (FIG. 2).

Furthermore, the free end of each switching lever 142 is connected to additional switches 144, for example of the microswitch type (see FIG. 3) that are themselves connected to the motor and supply information to it about the selected mode, so as to cut off the power supply from the motor if one of the two manual switching modes is selected.

Now will be described operation of the locking mechanism 100 operating with the control device, and with reference to FIGS. 2, 3, 4 and 6.

FIGS. 2 and 3 show the control mechanism 10 and the locking mechanism 100 assembly, in a configuration corresponding to the motor driven switching mode. The actuation lever 112 is in its neutral position 112-1. It is positioned such that the lever hole 118 is facing the passage hole 104. The bolt stem 134 is positioned such that it passes successively through the lever hole 118 between the two extension tabs 120 and penetrates into the passage hole 104. When in its position, the locking lever 114 closes off the passage hole 104 such that the bolt stem 134 stops in contact with the locking lever 114 without being able to pass through the passage hole 104. Consequently, the bolt stem 134 does not engage on the free end of the auxiliary shaft 106. Therefore the auxiliary shaft 106 is free to turn, driven by the motor 2. The padlock 140 is installed (FIG. 3) so as to immobilise the locking mechanism 100 in this position, each arm of the padlock 140 being positioned in one of the stop bolt holes 138. The presence of the stop bolt 130 when positioned in this manner prevents the actuation lever 112 from pivoting towards one of the two extreme positions 112-2, 112-3. The locking lever 114 is then positioned in the same way as the actuation lever 112, on the other side of the plate 102. In this configuration, the connecting rod 98 is positioned such that the mode selector lever 30 connected to the first end of the connecting rod 98 is in its neutral position 30-1, and the motor driven switching mode of the electrical switchgear is selected.

FIG. 4 shows the control mechanism 10 and the locking mechanism 100, in a configuration corresponding to the second manual switching mode between the open position and the earthing position of the electrical switchgear. The actuation lever 112 is in its second extreme position 112-3. It is positioned such that the lever hole 118 is not facing the passage hole 104, but is at its left in FIG. 4. The bolt stem 134 is positioned such that it passes only through the passage hole 104, without passing through the thickness of the actuation lever 112. The bolt head 132 is placed directly in contact with the plate 102. Consequently, the bolt stem 134 is long enough so that it can engage on the free end of the auxiliary shaft 106, the notches 136 being engaged with the pins 107. The padlock 140 is installed so as to immobilize the locking mechanism 100 in this configuration, and to immobilize the auxiliary shaft 106 and the motor 2 to prevent accidental operation of the control device 10. One of the arms of the padlock 140 passes through the stop bolt hole 138 furthest from the plate 102 and one of the extension tabs 120, and the other arm of the padlock 140 does not pass through any part. The locking lever 114 is positioned in the same way as the actuation lever 112, on the other side of the plate 102. In this configuration, the connecting rod 98 is positioned such that the mode selector lever 30 connected to the first end of the connecting rod 98 is in its second extreme position 30-3, and the second manual switching mode between the open position and the earthing position of the electrical switchgear is selected.

To use the control device 10 manually, the padlock 140 and the stop bolt 130 are removed and a manoeuvre member, not shown, may be coupled to the auxiliary shaft 106. This manoeuvre member, for example a crank, is inserted into the passage hole 104 and is coupled to the auxiliary shaft 106 that then drives the set of gears 4.

FIG. 6 shows the locking mechanism 100 in a configuration corresponding to the first manual switching mode between the open position and the closed position of the electrical switchgear. The actuation lever 112 is in its first extreme position 112-2. It is positioned such that the lever hole 118 is not facing the passage hole 104, but is on its right in FIG. 6. The bolt stem 134 is positioned such that it passes only through the passage hole 104 without having to pass through the thickness of the actuation lever 112. The bolt head 132 is placed directly in contact with the plate 102. Consequently, the bolt stem 134 is long enough so that it can engage on the free end of the auxiliary shaft 106, the notches 136 being engaged with the pins 107. The padlock 140 is not shown, but it can be installed in a manner similar to that shown in FIG. 4, so as to immobilize the locking mechanism 100 in this configuration and to immobilize the auxiliary shaft 106 and the motor 2 to prevent any accidental operation of the control device 10. The locking lever 114 is positioned in the same way as the actuation lever 112, on the other side of the plate 102. In this configuration, the connecting rod 98 is positioned such that the mode selector lever 30 connected to the first end of the connecting rod 98 is in its first extreme position 30-2, and the first manual switching mode between the open position and the closed position of the electrical switchgear is selected.

Of course, the invention is not limited to the embodiment that has just been described. Variant embodiments performing the same functions could also be considered.

For example, the opening 40 is a through opening, but it could be replaced by a recess on the lower face of the mode selector lever 30.

For example, there are two switching levers 142, but there could be a single lever or they could be three or more.

Furthermore, the locking mechanism 100 and the auxiliary shaft 106 could be arranged with a different orientation, for example the auxiliary shaft 106 could be parallel to the main shaft 14 and to the drive shaft 28.

The invention claimed is:

1. A control device (10, 10') for an electrical switchgear with three switching positions including a closed position, an open position and an earthing position, and comprising a main shaft (14) and a drive shaft (28), the control device intended to be coupled to a mobile contact of said electrical switchgear, the control device comprising:

a mode selector lever (30) selecting one operating mode among a motor driven switching mode, a first manual switching mode between the open position and the closed position of the electrical switchgear, and a second manual switching mode between the open position and the earthing position of the electrical switchgear, said mode selector lever (30) comprising an opening (40), and a cam disk (50), fixed on the drive shaft (28), with a cam (54) capable of moving inside said opening (40), such that the displacement of the cam disk (50) is free when the control device (10) is in the motor driven switching mode, limited to a first angular rotation range (50-1) of the drive shaft (28) when the control device (10) is in the first manual switching mode, and limited to a second angular rotation range (50-2) of the drive shaft (28) when the control device (10) is in the second manual switching mode.

2. The control device (10, 10') according to claim 1, characterised in that the mode selector lever (30) moves between: a neutral position (30-1), in which the motor driven switching mode is selected, that may be reached for any angular position of the main shaft (14), a first extreme position (30-2), in which the first manual switching mode between the open position and the closed position of the electrical switchgear is selected, and that can be reached when the angular position of the main shaft (14) is in a first angular range, a second extreme position (30-3), in which the second manual switching mode between the open position and the earthing position of the electrical switchgear is selected, and that can be reached when the angular position of the main shaft (14) is in a second angular range.

3. The control device (10, 10') according to claim 1, characterised in that the cam (54) has a substantially circular or elliptical or oval contour and has a centre of curvature that is coincident with the centre of curvature of the cam disk (50), and in that it is connected to the cam disk (50) by two connecting areas that define two circumferential noses (56).

4. The control device (10, 10') according to claim 1, characterised in that the opening (40) of the mode selector lever (30) has a contour that comprises two curved portions (42, 43) connected to each other by two intermediate portions (44), the curved portions (42, 43) and the intermediate portions (44) being separated by connecting areas that define two connecting notches (46).

5. The control device (10, 10') according to claim 1, characterised in that it comprises a transmission and interlocking disk (16, 16'), fixed on the main shaft (14), said transmission and interlocking disk (16, 16') comprising a first part of the disk (18) that is functionally connected to position indicating equipment, and a second part of the disk (20) that cooperates with the mode selector lever (30) to prevent it from being in a wrong position during displacement, as a function of the angular position of the main shaft (14).

6. The control device (10, 10') according to claim 5, characterised in that the first part of the disk (18) is fitted with teeth around its periphery, said teeth being designed to engage with teeth in a control bar (22) that is functionally connected to auxiliary switches (13) and to a position indicator (26).

7. The control device (10, 10') according to claim 5, characterised in that the second part of the disk (20) comprises a slit (202) substantially in the shape of two ring portions radially offset from each other and in communication with each other.

8. The control device (10, 10') according to claim 6, characterised in that the second part of the disk (20) comprises a slit (202) substantially in the shape of two ring portions radially offset from each other and in communication with each other.

9. The control device (10, 10') according to claim 8, characterised in that it comprises a spindle (48) fixed to the mode selector lever (30), and in that said spindle (48) engages in said slit (202) to prevent the mode selector lever (30) from being in a wrong position during its displacement as a function of the angular position of the main shaft (14).

10. The control device (10, 10') according to claim 9, characterised in that the spindle (48) extends substantially perpendicular from a face of the mode selector lever (30) that is facing the transmission and interlocking disk (16, 16').

11. The control device (10, 10') according to claim 5, characterised in that the transmission and interlocking disk (16, 16') is driven by a driven disk (84, 84') supported on the main shaft (14), said driven disk (84, 84') itself being driven by a roller wheel (60) fixed on the drive shaft (28), in which the driven disk (84, 84') is provided with two recesses (86) and two stop areas (88) such that said driven disk (84, 84') and said roller wheel (60) form a Geneva drive mechanism.

12. The control device (10) according to claim 11, characterised in that said Geneva drive mechanism limits rotation of the main shaft (14) within an angular range of 120 degrees.

13. The control device (10) according to claim 11, characterised in that the driven disk (84) is rigidly fixed to the main shaft (14) and drives the main shaft (14) and the transmission and interlocking disk (16) fixed on said main shaft (14).

14. The control device (10') according to claim 11, characterised in that the driven disk (84') has a degree of freedom in rotation about said main shaft (14) and a degree of freedom in translation along said main shaft (14), in that the driven disk (84') drives the transmission and interlocking disk (16'), the driven disk (84') being applied elastically in contact with the transmission and interlocking disk (16') through a return means (90), and each of said driven disk (84') and transmission and interlocking disk (16') comprises corresponding holes (154, 150) that coincide so as to form cavities inside which balls (152) are arranged, the combination of the transmission and interlocking disk (16'), the driven disk (84'), the return means (90), balls (152) and holes (150, 154) forming a torque limiting mechanism.

15. The control device (10, 10') according to claim 10, wherein the cam (54) has a substantially circular or elliptical or oval contour and has a centre of curvature that is coincident with the centre of curvature of the cam disk (50), wherein the cam (54) is connected to the cam disk (50) by two connecting areas that define two circumferential noses (56), and wherein the opening (40) of the mode selector lever (30) has a contour that comprises two curved portions (42, 43) connected to each other by two intermediate portions (44), the curved portions (42, 43) and the intermediate portions (44) being separated by connecting areas that define two connecting notches (46), characterised in that rotation of the first cam disk (50) is interrupted:

either when the mode selector lever (30) is in the first extreme position (30-2) and the electrical switchgear is in the open position, since a first of the noses (56) of the cam (54) on the cam disk (50) stops in contact with a first connecting notch (46) of the opening (40) in the mode selector lever (30), or when the mode selector lever (30) is in the first extreme position (30-2) and the electrical switchgear is in the closed position, since a first of the rollers (62, 63) of the wheel (60) stops in contact with one of the stop areas (88) of the driven disk (84, 84') during operation of the Geneva drive mechanism, or when the mode selector lever (30) is in the second extreme position (30-3) and the electrical switchgear is in the open position, since a second of the noses (56) of the cam (54) on the cam disk (50) stops in contact with a second connecting notch (46) of the opening (40) of the mode selector lever (30), or when the mode selector lever (30) is in the second extreme position (30-3) and the electrical switchgear is in the earthing position, since a second of the rollers (62, 63) of the wheel (60) stops in contact with the other of the stop areas (88) of the driven disk (84, 84') during operation of the Geneva drive mechanism.

16. The control device (10, 10') according to claim 1, characterised in that it comprises an actuation lever (112) that is functionally connected to the mode selector lever (30), such that the motor driven switching mode or one of the two manual switching modes can be selected by positioning the actuation lever (112) in one of the following three positions:

a neutral position (112-1) corresponding to the neutral position (30-1) of the mode selector lever (30), through which the motor driven switching mode is selected, a first extreme position (112-2) corresponding to the first extreme position (30-2) of the mode selector lever (30), and through which the first manual switching mode between the open position and the closed position of the electrical switchgear is selected, a second extreme position (112-3) corresponding to the first extreme position (30-3) of the mode selector lever (30), and through which the second manual switching mode between the open position and the earthing position of the electrical switchgear is selected.

17. The control device (10, 10') according to claim 16, characterised in that displacement of the actuation lever (112) causes displacement of a connecting rod (98) that is connected to the mode selector lever (30) and that controls displacement of the mode selector lever (30).

18. The control device (10, 10') according to claim 16, characterised in that the actuation lever (112) can pivot about a pivot shaft (116), in a plane perpendicular to an auxiliary shaft (106).

19. The control device (10, 10') according to claim 16, characterised in that it is functionally connected to a locking mechanism (100) that comprises a locking lever (114) rigidly fixed to the actuation lever (112) and a stop bolt (130), the control device (10) and the locking mechanism (100) being arranged in a housing (12), such that the actuation lever (112) and the stop bolt (130) are arranged on the outside of a wall of said housing (12), while the locking lever (114) is arranged on the inside of said wall of said housing (12).

20. The control device (10, 10') according to claim 19, characterised in that:

the housing (12) is provided with a passage hole (104), the stop bolt (130) is provided with a bolt stem (134), and in that when the motor driven switching mode is selected, the locking lever (114) is positioned facing the passage hole (104), so as to prevent the bolt stem (134) or a manoeuvre member from coupling with the auxiliary shaft (106).

21. The control device (10, 10') according to claim 19, characterised in that:

the housing (12) is provided with a passage hole (104), the stop bolt (130) is provided with a bolt stem (134), and in that when one of the manual switching modes is selected, the locking lever (114) is positioned so as to release the passage hole (104), so that a bolt stem (134) or a member can be coupled with the auxiliary shaft (106).

22. The control device (10, 10') according to claim 16, characterised in that the stop bolt (130) and the actuation lever (112) are locked together in a position corresponding to the motor driven switching mode or in a position corresponding to either of the two manual switching modes, by means of a padlock (140) with arms that pass through at least one locking hole (122) in the actuation lever (112) and at least one hole (138) in the stop bolt (130).

23. The control device (10, 10') according to claim 16, characterised in that it comprises at least one switching lever (142) associated with the locking mechanism (100), said at least one switching lever (142) being connected to additional switches (144) themselves connected to the motor, to inform said motor about which switching mode is selected.

* * * * *